US009543660B2

(12) United States Patent
Rajagopalan et al.

(10) Patent No.: US 9,543,660 B2
(45) Date of Patent: Jan. 10, 2017

(54) ELECTRONIC DEVICE CAVITY ANTENNAS WITH SLOTS AND MONOPOLES

(71) Applicant: Apple Inc., Cupertino, CA (US)

(72) Inventors: Harish Rajagopalan, San Jose, CA (US); Huan-Chu Huang, Taoyuan County (TW); Ke Sun, Beijing (CN); Qingxiang Li, Mountain View, CA (US); Robert W. Schlub, Cupertino, CA (US); Rodney A. Gomez Angulo, Sunnyvale, CA (US); Umar Azad, San Jose, CA (US)

(73) Assignee: Apple Inc., Cupertino, CA (US)

( * ) Notice: Subject to any disclaimer, the term of this patent is extended or adjusted under 35 U.S.C. 154(b) by 152 days.

(21) Appl. No.: 14/510,724

(22) Filed: Oct. 9, 2014

(65) Prior Publication Data

US 2016/0104944 A1 Apr. 14, 2016

(51) Int. Cl.

| | |
|---|---|
| ***H01Q 1/24*** | (2006.01) |
| ***H01Q 21/00*** | (2006.01) |
| ***H01Q 9/04*** | (2006.01) |
| ***H01Q 13/18*** | (2006.01) |
| ***H01Q 9/42*** | (2006.01) |

(Continued)

(52) U.S. Cl.

CPC ..... *H01Q 21/005* (2013.01); *H01Q 5/378* (2015.01); *H01Q 9/045* (2013.01); *H01Q 9/42* (2013.01); *H01Q 13/18* (2013.01); *H01Q 21/30* (2013.01); *H01Q 1/243* (2013.01); *H01Q 9/36* (2013.01)

(58) Field of Classification Search

USPC ..... 343/702, 700 MS, 767, 725, 826

See application file for complete search history.

(56) References Cited

U.S. PATENT DOCUMENTS

| | | | |
|---|---|---|---|
| 5,369,413 | A | 11/1994 | Hannan |
| 6,028,561 | A | 2/2000 | Takei |

(Continued)

FOREIGN PATENT DOCUMENTS

| | | |
|---|---|---|
| KR | 10-2005-0034196 | 4/2005 |
| KR | 10-2007-0098020 | 10/2007 |

(Continued)

OTHER PUBLICATIONS

Ranga, Y. et al. "Compact High-Gain Short-Horn Antenna for UWB Applications", Proceedings of the 5th European Conference on Antennas and Propagation (EUCAP), IEEE, Apr. 11-15, 2011, pp. 1511-1513.

*Primary Examiner* — Hoang V Nguyen
*Assistant Examiner* — Hai Tran
(74) *Attorney, Agent, or Firm* — Treyz Law Group, P.C.; G. Victor Treyz; Michael H. Lyons

(57) ABSTRACT

An electronic device may be provided with wireless circuitry. The wireless circuitry may include cavity antennas. A cavity antenna may be formed from a metal antenna cavity and resonating element structures. The metal antenna cavity may be formed from metal traces on a dielectric carrier. The resonating element structures may include directly fed and indirectly fed slot antenna resonating elements and monopole antenna resonating elements. The metal antenna cavity may exhibit a resonance that is tuned using a transmission line tuning stub. Filters and duplexer circuits may be used in routing signals at different frequency bands among the antenna resonating elements.

20 Claims, 8 Drawing Sheets

(51) Int. Cl.

| | |
|---|---|
| ***H01Q 21/30*** | (2006.01) |
| ***H01Q 5/378*** | (2015.01) |
| *H01Q 9/36* | (2006.01) |

(56) References Cited

U.S. PATENT DOCUMENTS

| | | | | |
|---|---|---|---|---|
| 8,183,956 | B2 * | 5/2012 | Hayashi | H04B 1/0057 333/126 |
| 8,860,532 | B2 | 10/2014 | Gong et al. | |
| 2009/0153412 | A1 * | 6/2009 | Chiang | H01Q 1/52 343/702 |
| 2010/0295737 | A1 * | 11/2010 | Milosavljevic | H01Q 1/24 343/702 |
| 2011/0006953 | A1 * | 1/2011 | Chiang | G06F 1/1616 343/702 |
| 2013/0038494 | A1 | 2/2013 | Kuonanoja | |
| 2013/0214986 | A1 | 8/2013 | Zhu et al. | |

FOREIGN PATENT DOCUMENTS

| | | |
|---|---|---|
| KR | 10-2012-0130011 | 11/2012 |
| KR | 10-2012-0137088 | 12/2012 |

* cited by examiner

ELECTRONIC DEVICE CAVITY ANTENNAS WITH SLOTS AND MONOPOLES

BACKGROUND

This relates generally to electronic devices and, more particularly, to electronic devices with antennas.

Electronic devices often include antennas. For example, cellular telephones, computers, and other devices often contain antennas for supporting wireless communications.

It can be challenging to form electronic device antenna structures with desired attributes. In some wireless devices, the presence of conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved antennas for electronic devices.

SUMMARY

An electronic device may be provided with wireless circuitry. The wireless circuitry may include cavity antennas. A cavity antenna may be formed from a metal antenna cavity and resonating element structures. The metal antenna cavity may be formed from metal traces on a dielectric carrier. The resonating element structures may include directly fed and indirectly fed slot antenna resonating elements and monopole antenna resonating elements. The metal antenna cavity may exhibit a resonance that is tuned using a transmission line tuning stub. Filters and duplexer circuits may be used in routing signals at different frequency bands among the antenna resonating elements.

With one arrangement, a cavity antenna may have a directly fed monopole antenna resonating element and a parasitic slot antenna resonating element that are backed by an antenna cavity. The monopole antenna resonating element and the parasitic antenna resonating element may contribute antenna responses at first and second respective frequencies to a high band resonance. The antenna cavity may exhibit a low band resonance that is tuned to a desired frequency using a transmission line tuning stub that is coupled to the monopole antenna resonating element by a low pass filter.

A cavity antenna first and second slot antenna resonating elements that are backed by a metal antenna cavity. The first and second slot antenna resonating elements may contribute antenna responses at first and second respective frequencies to a high band resonance. A monopole antenna resonating element may exhibit a low band resonance. The first slot antenna element may be directly fed and the second slot antenna element may be a parasitic element that is indirectly fed by the first slot. A duplexer may route high band signals to the slots and low band signals to the monopole. A segment of coaxial cable may couple the duplexer to the monopole antenna resonating element. The antenna cavity may be covered with a metal layer that has openings to form the first and second slots. The segment of coaxial cable may have an outer conductor that is shorted along its length to the metal layer.

A cavity antenna may include first and second slot antenna resonating elements that are backed by an antenna cavity and a monopole antenna resonating element that is not backed by the antenna cavity. The first slot antenna resonating element may be directly fed. The second slot antenna resonating element may be near-field coupled to the first slot antenna resonating element and may broaden the bandwidth of the antenna in a high frequency band (e.g., a band at 5 GHz). A transmission line may be coupled to a radio-frequency transceiver operating at 2.4 GHz and 5 GHz. A low pass filter may be coupled between the transmission line and the monopole antenna resonating element to allow 2.4 GHz signals to pass to and from the monopole antenna resonating element. A high pass filter may be coupled between the transmission line and the first slot antenna to allow 5 GHz signals to pass to and from the first and second slot antenna resonating elements.

DETAILED DESCRIPTION

Figure 1:
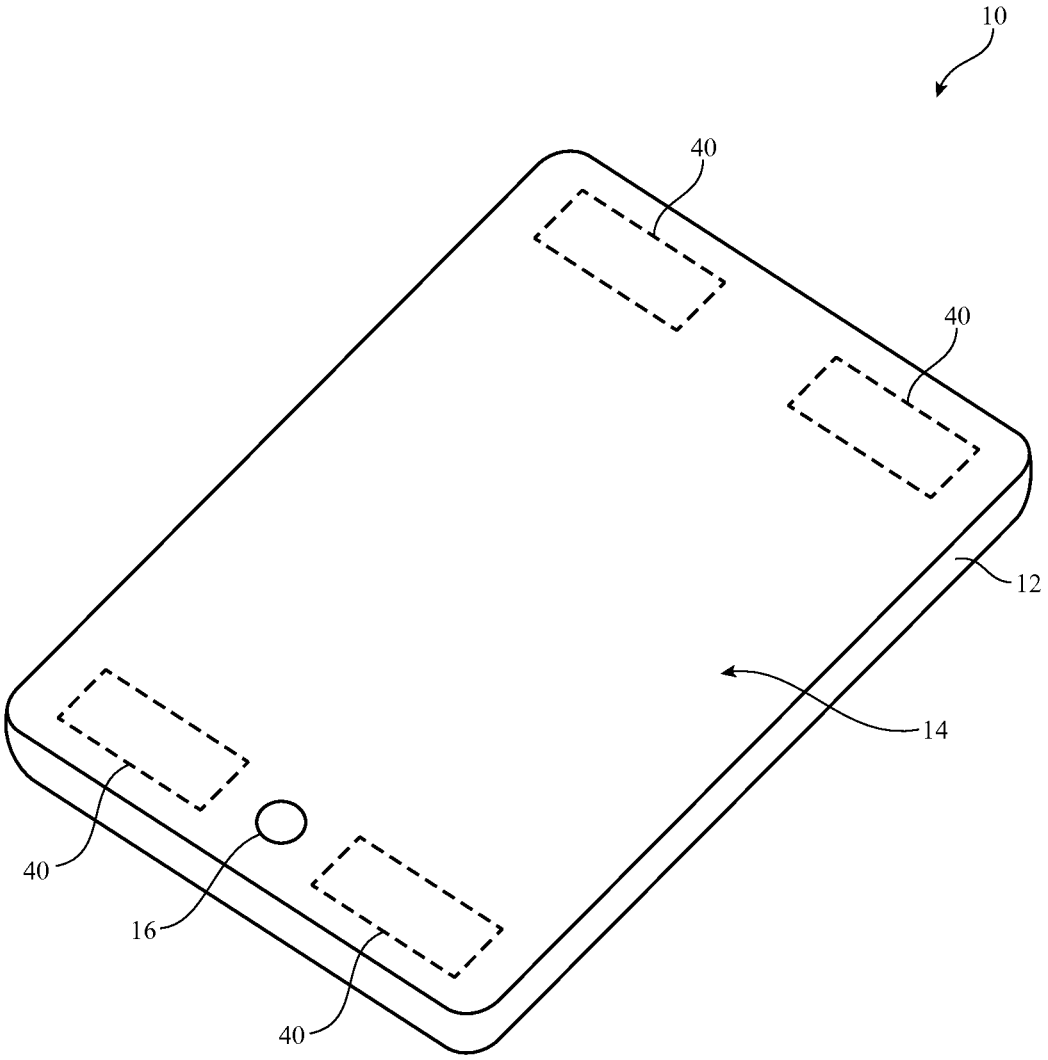
FIG. 1 is a perspective view of an illustrative electronic device with wireless communications circuitry in accordance with an embodiment.

An electronic device such as electronic device 10 of FIG. 1 may contain wireless circuitry. The wireless circuitry may include antenna structures such as one or more cavity antennas.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

In the example of FIG. 1, device 10 includes a display such as display 14. Display 14 has been mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of pixels formed from liquid crystal display (LCD) components, an array of electrophoretic pixels, an array of plasma pixels, an array of organic light-emitting diode pixels, an array of electrowetting pixels, or pixels based on other display technologies.

Display 14 may be protected using a display cover layer such as a layer of transparent glass or clear plastic. Openings may be formed in the display cover layer. For example, an opening may be formed in the display cover layer to accommodate a button such as button 16. An opening may also be formed in the display cover layer to accommodate ports such as a speaker port. Openings may be formed in housing 12 to form communications ports (e.g., an audio jack port, a digital data port, etc.). Openings in housing 12 may also be formed for audio components such as a speaker and/or a microphone.

Antennas may be mounted in housing 12. For example, housing 12 may have four peripheral edges as shown in FIG. 1 and one or more antennas 40 may be mounted along the edges of housing 12, at the corners of housing 12 (as shown in FIG. 1) or elsewhere in device 10. There may be any suitable number of antennas 40 in device 10 (e.g., one antenna, two antennas, three antennas, or four or more antennas).

Figure 2:
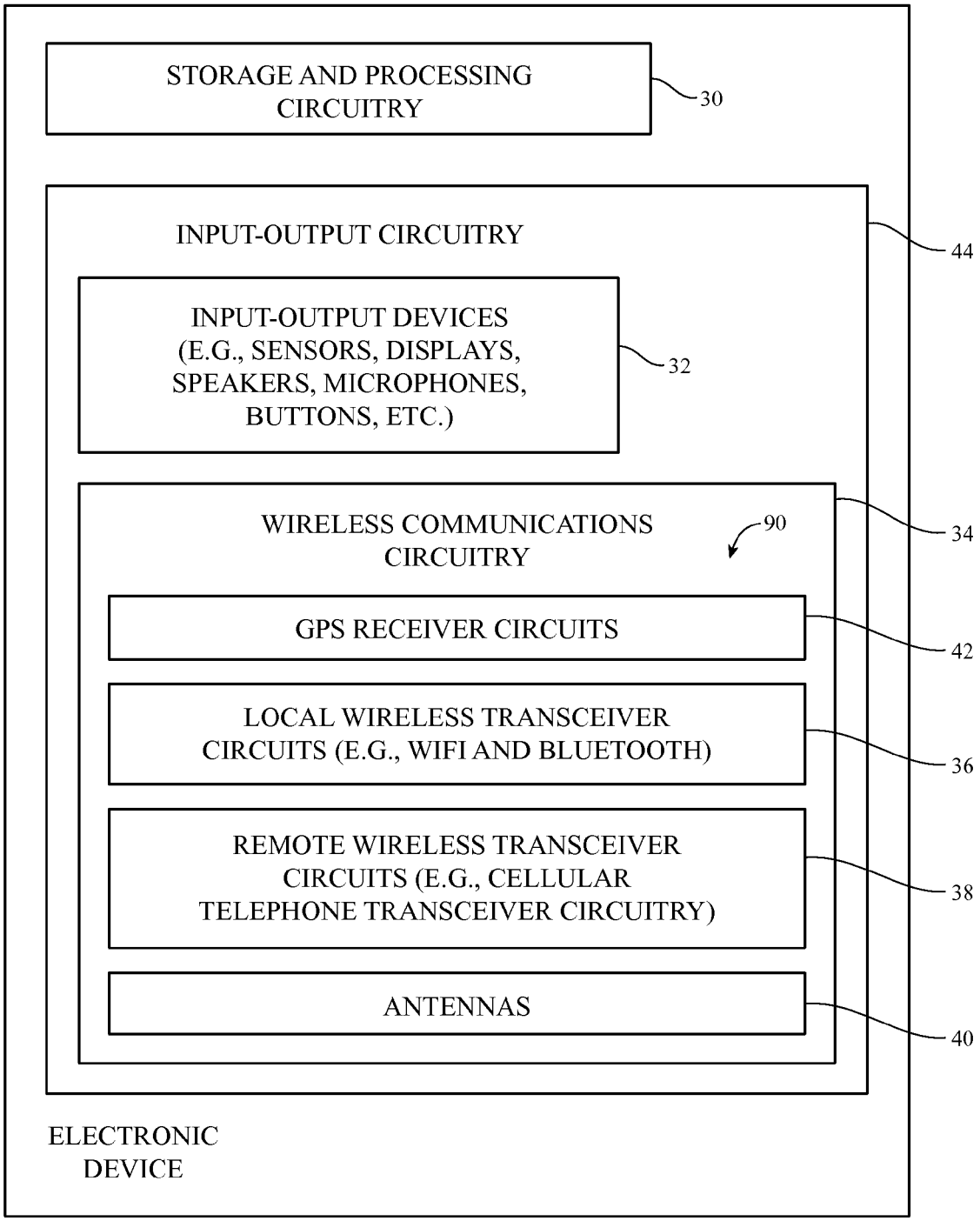
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include control circuitry such as storage and processing circuitry 30. Storage and processing circuitry 30 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 30 may be used to control the operation of device 10. This processing circuitry may be based on one or more microprocessors, microcontrollers, digital signal processors, baseband processor integrated circuits, application specific integrated circuits, etc.

Storage and processing circuitry 30 may be used to run software on device 10, such as internet browsing applications, voice-over-internet-protocol (VOIP) telephone call applications, email applications, media playback applications, operating system functions, etc. To support interactions with external equipment, storage and processing circuitry 30 may be used in implementing communications protocols. Communications protocols that may be implemented using storage and processing circuitry 30 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, satellite navigation system protocols, etc.

Device 10 may include input-output circuitry 44. Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, a connector port sensor or other sensor that determines whether device 10 is mounted in a dock, and other sensors and input-output components.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42.

Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band.

Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data.

Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc.

Wireless communications circuitry 34 may include satellite navigation system circuitry such as global positioning system (GPS) receiver circuitry 42 for receiving GPS signals at 1575 MHz or for handling other satellite positioning data (e.g., GLONASS signals at 1609 MHz). In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Antennas 40 in wireless communications circuitry 34 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. If desired, one or more of antennas 40 may be cavity-backed antennas formed by placing slot antennas, monopole antennas, and other resonating element structures over the opening in a metal antenna cavity. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals).

Transmission line paths may be used to couple antenna structures 40 to transceiver circuitry 90. Transmission lines in device 10 may include coaxial cable paths, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within the transmission lines, if desired.

Device 10 may contain multiple antennas 40. The antennas may be used together or one of the antennas may be switched into use while the other antenna(s) may be switched out of use. If desired, control circuitry 30 may be used to select an optimum antenna to use in device 10 in real time and/or an optimum setting for a phase shifter or other wireless circuitry coupled to the antennas (e.g., an optimum antenna to receive satellite navigation system signals, etc.). Control circuitry 30 may, for example, make an antenna selection or antenna array phase adjustment based on information on received signal strength, based on sensor data (e.g., orientation information from an accelerometer), based on other sensor information (e.g., information indicating whether device 10 has been mounted in a dock in a portrait orientation), or based on other information about the operation of device 10.

Figure 3:
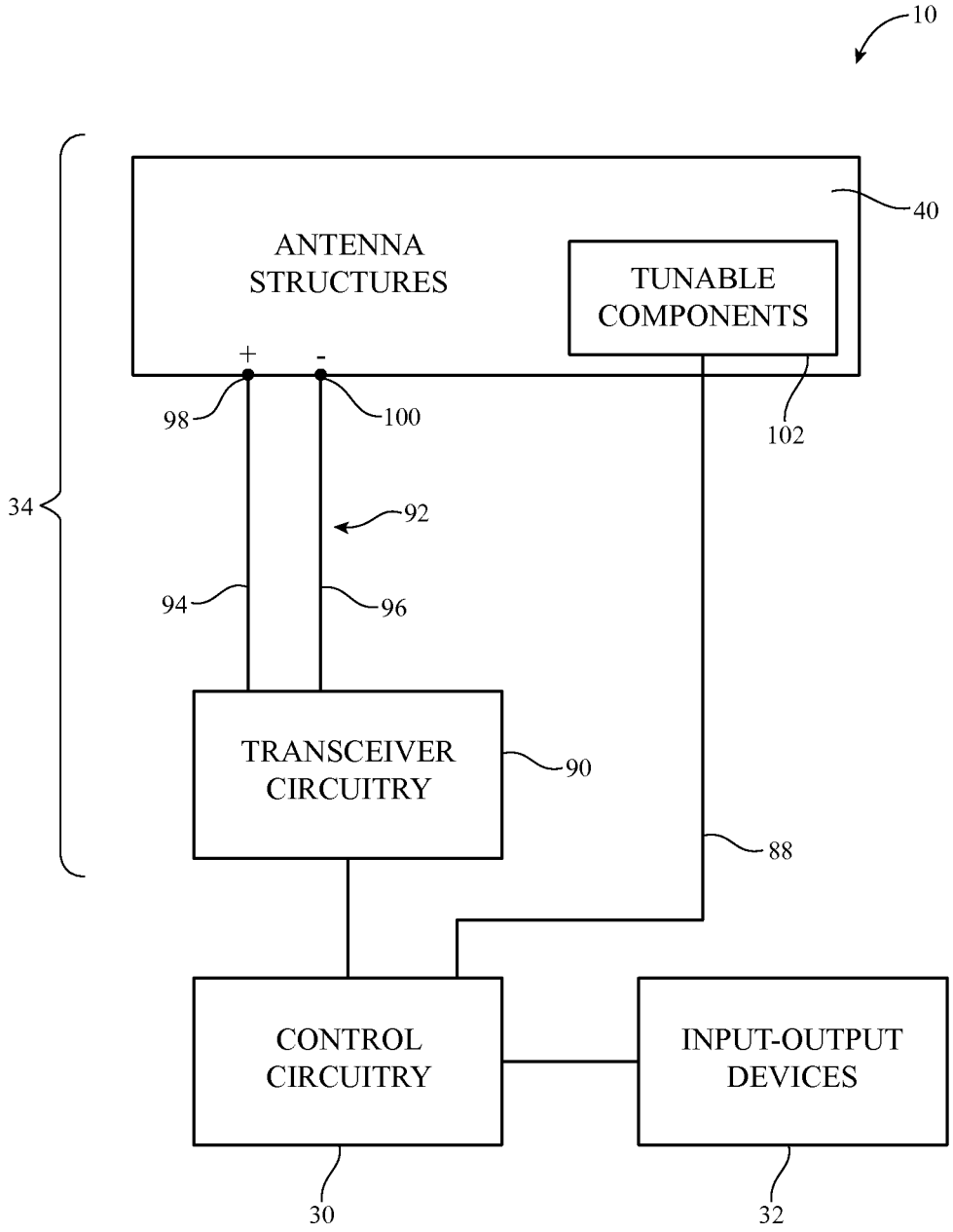
FIG. 3 is a diagram of illustrative wireless circuitry in accordance with an embodiment.

As shown in FIG. 3, transceiver circuitry 90 in wireless circuitry 34 may be coupled to antenna structures 40 using paths such as transmission line path 92. Wireless circuitry 34 may be coupled to control circuitry 30. Control circuitry 30 may be coupled to input-output devices 32. Input-output devices 32 may supply output from device 10 and may receive input from sources that are external to device 10.

To provide antenna structures 40 with the ability to cover communications frequencies of interest, antenna structures 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 40 may be provided with adjustable circuits such as tunable components 102 to tune antennas over communications bands of interest. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 30 may issue control signals on one or more paths such as path 88 that adjust inductance values, capacitance values, or other parameters associated with tunable components 102, thereby tuning antenna structures 40 to cover desired communications bands. Configurations in which antennas 40 are fixed (not tunable) may also be used.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable or a microstrip transmission line on a printed circuit (as examples). A matching network formed from components such as inductors, resistors, and capacitors may be used in matching the impedance of antenna structures 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna structures 40.

Transmission line 92 may be coupled to antenna feed structures associated with antenna structures 40. As an example, antenna structures 40 may form an inverted-F antenna, a slot antenna, a hybrid inverted-F slot antenna, a monopole antenna, an antenna having a parasitic antenna resonating element, or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. The illustrative feeding configuration of FIG. 3 is merely illustrative.

It may be desirable to form one or more of antennas 40 using cavity-backed antenna designs. In a cavity antenna, a metal cavity forms antenna ground. The antenna cavity may be formed by metal traces on a plastic carrier (e.g., plated metal traces), may be formed from stamped metal structures, may be formed from portions of housing 12, or may be formed from other conductive structures. The cavity may, as an example, have a box shape with an open top. One or more resonating elements may be formed in the open top. Cavity antennas may offer good isolation with respect to internal components in device 10 and other antennas and may satisfy limits on emitted radiation levels (sometimes known as specific absorption rate limits).

Figure 4:
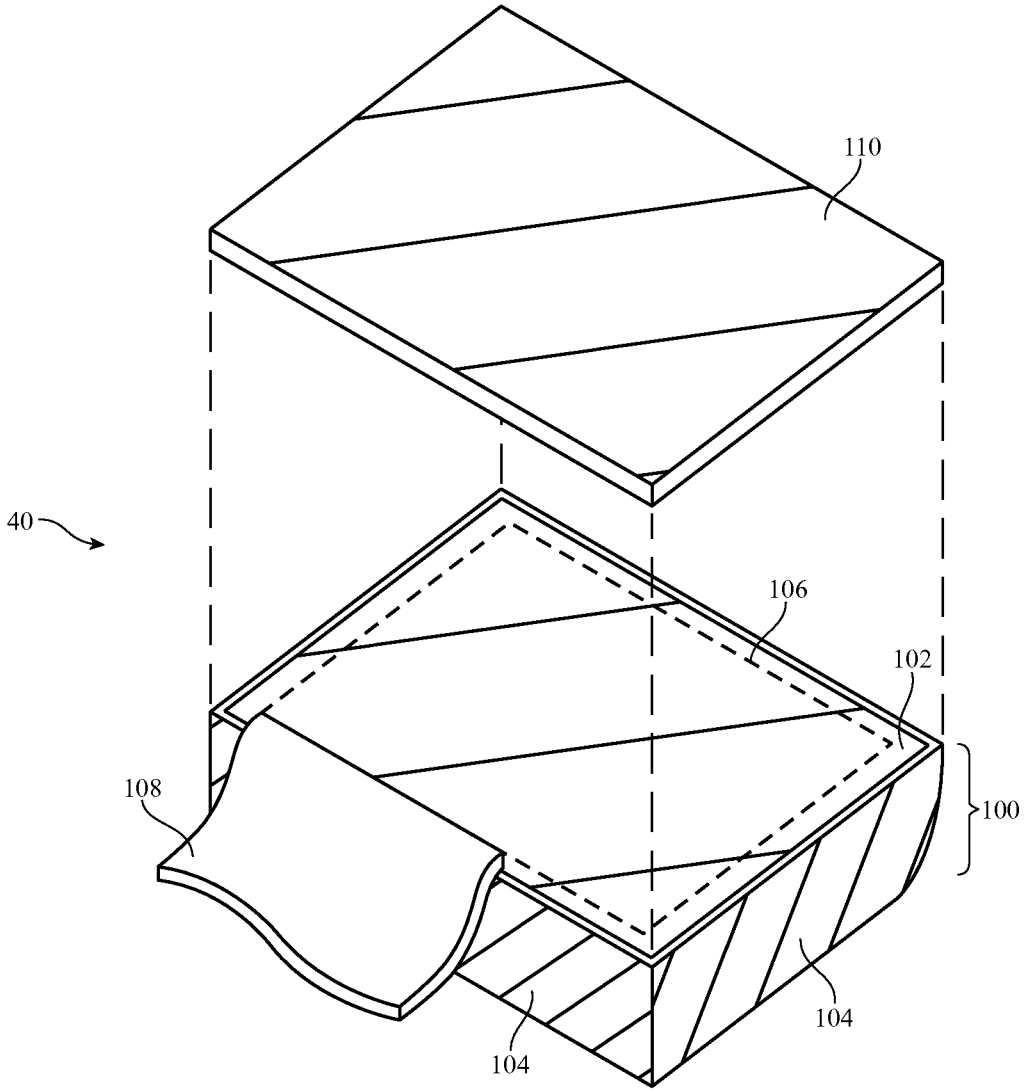
FIG. 4 is a perspective view of an illustrative cavity antenna in accordance with an embodiment.

FIG. 4 is an exploded perspective view of an illustrative cavity antenna. As shown in FIG. 4, illustrative antenna 40 of FIG. 4 has cavity 100. Cavity 100 may have a hollow interior or may have an internal dielectric support structure such as a plastic carrier. The plastic carrier may have one or more air-filled cavities or may be solid. Structures based on foam and other dielectric materials may also be used, if desired.

Metal cavity walls 104 may be formed on the surfaces of the dielectric carrier (as an example). Metal cavity walls 104 may be formed on the lower surface of the carrier and on front, back, left, and right sidewalls of the carrier to form an open-topped box or other cavity shapes may be formed. One or more antenna resonating elements or other structures may be mounted in region 106 in the top surface of the box so that these antenna resonating elements are backed by the cavity.

If desired, metal coating layer 102 may cover some of the top of the box forming cavity 100. Metal coating layer 102 may be formed from metal traces on a plastic carrier, patterned metal foil, traces on a printed circuit that overlap the opening in cavity 100, and/or other suitable structures. Slot antenna resonating elements may be formed from openings in layer 102. Antenna structures may also be formed using wires, cables, portions of housing 12, metal structures such as brackets, metal traces on printed circuits, etc. The metal structures in region 106 and elsewhere in antenna 40 may be patterned to form monopole elements, slot antennas (i.e., antennas formed from openings in metal), inverted-F antenna resonating elements, or other suitable antenna elements.

In the example of FIG. 4, cavity 100 has four sidewalls, one of which is curved to allow antenna 40 to be mounted along a curved inner surface of a curved wall of housing 12. Other cavity shapes may be used if desired.

Antenna 40 may be fed using signals that are conveyed to antenna 40 using a transmission line. The transmission line may be coupled to one or more portions of antenna 40. The transmission line may be a coaxial cable, may be a microstrip transmission line in flexible printed circuit 108 or other printed circuit, or may be any other suitable transmission line. If desired, optional dielectric loading layer 110 may be placed on top of region 106 (e.g., to provide dielectric loading for the antenna that helps tune antenna 40).

Figure 5:
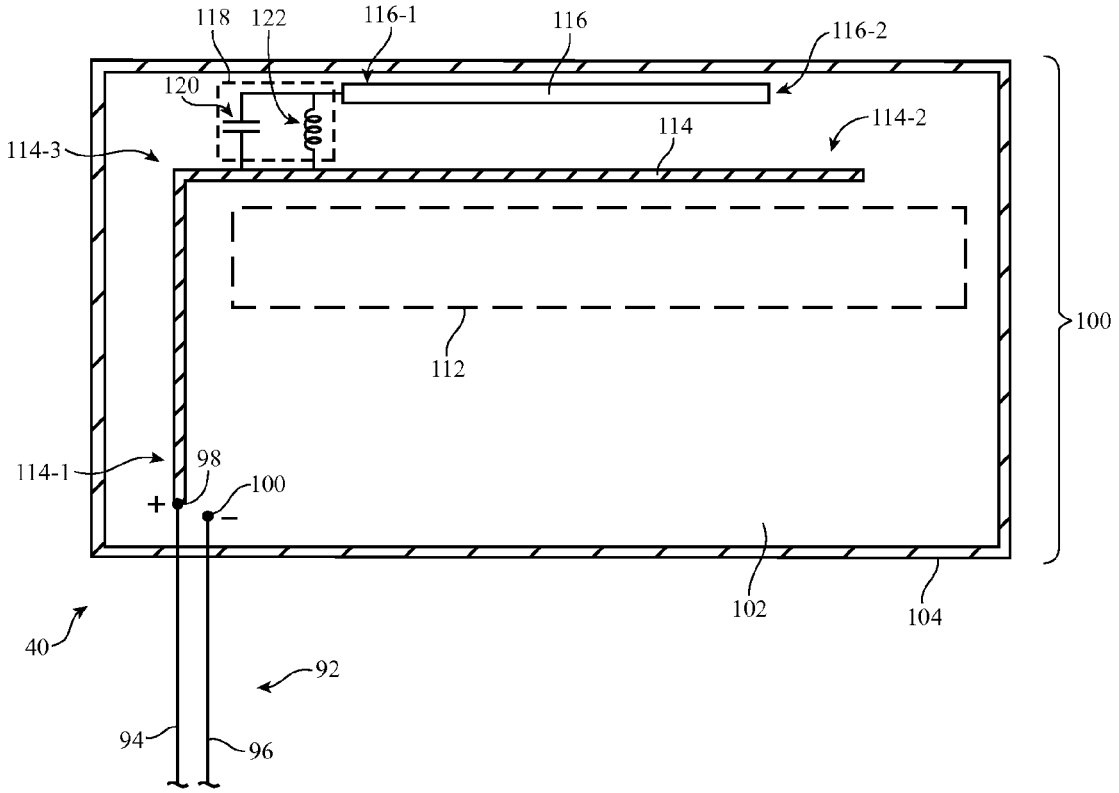
FIG. 5 is a top view of an illustrative cavity antenna with a monopole resonating element, a parasitic slot resonating element, and a transmission line tuning stub to tune a cavity resonance for the antenna in accordance with an embodiment.

FIG. 5 is a top view of antenna 40 in an illustrative configuration that includes a transmission line tuning stub. Antenna 40 may operate in a band at 5 GHz (e.g., to support wireless area network communications such as IEEE 802.11 communications) and may operate in a band at 2.4 GHz (e.g., to support wireless local area network communications such as IEEE 802.11 communications, to support Bluetooth® communications, and/or to support cellular telephone communications.

As shown in FIG. 5, antenna 40 may have a cavity such as cavity 100 of FIG. 4. The upper surface of cavity 100 may be covered with metal 102. Parasitic slot antenna resonating element 112 may be formed from an opening in metal 102 (e.g., an elongated rectangular opening or other elongated slot opening that is backed by cavity 100). Monopole antenna resonating element 114 may be directly fed using antenna feed terminals 98 and 100. Transmission line 92 may have a positive signal line such as line 94 that is coupled to positive antenna feed terminal 98 and a ground signal line such as line 96 that is coupled to ground antenna feed terminal 100.

Monopole antenna resonating element 114 may overlap the upper surface of cavity 100 (i.e., element 114 may be backed by cavity 100) and may be separated from metal layer 102 by a layer of dielectric or other suitable structure. As shown in FIG. 5, monopole element 114 may have first and second opposing ends such as ends 114-1 and 114-2. End 114-1 may be coupled to positive terminal 98. Element 114 may be bent at bend 114-3, so that element 114 has an L shape or other suitable shape. The segment of element 114 that extends between bend 114-3 and end 114-2 may run parallel to slot 112.

Transmission line stub 116 may be formed from a segment of coaxial cable or other transmission line. Stub 116 may tune a cavity resonance associated with cavity 100 so that antenna 40 resonates at desired frequencies. Low pass filter 118 may have circuit elements such as capacitor 120 and inductor 122. Capacitor 120 and inductor 122 may be coupled in parallel between monopole element 114 and end 116-1 of stub 116. Stub 116 may run parallel to element 114 between end 116-1 and end 116-2.

Figure 6:
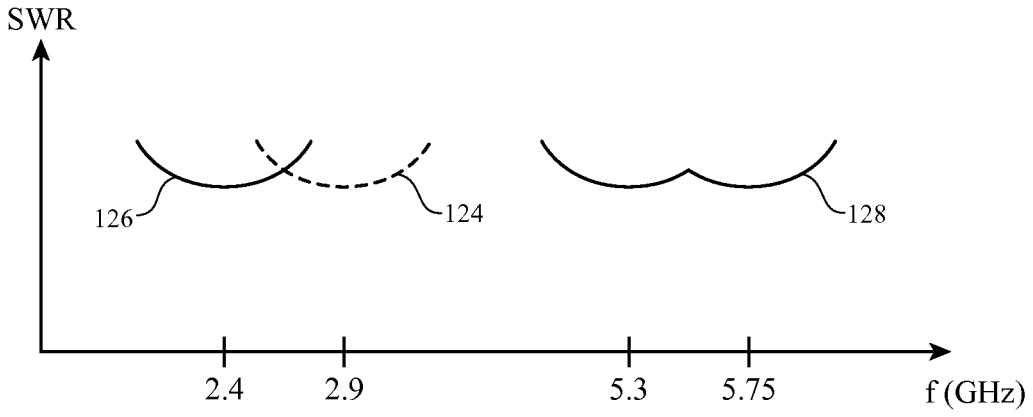
FIG. 6 is a graph in which antenna performance (standing wave ratio) has been plotted as a function of operating frequency for an antenna of the type shown in FIG. 5 in accordance with an embodiment.

FIG. 6 is a graph of antenna performance (standing wave ratio SWR) for antenna 40 of FIG. 5. As shown in FIG. 6, antenna 40 may exhibit an antenna resonance at 2.4 GHz (curve 126) and a resonance at 5 GHz (curve 128). During operation, monopole element 114 may resonate at 5.3 GHz and may therefore contribute a response at 5.3 GHz to resonance 128. Slot element 112 is indirectly fed through near-field electromagnetic coupling from element 114. Slot 112 may resonate at 5.7 GHz and may therefore contribute a broadening response at 5.7 GHz to resonance 128.

Low pass filter 118 may block signals at 5 GHz and thereby isolate cavity 100 from tuning stub 116. Cavity 100 may have a size (e.g., 12 mm by 18 mm or other suitable size that is sufficiently small to allow nearby components to be mounted within the limited interior volume of housing 12). In the absence of tuning stub 116, cavity 100 may resonate at a frequency such as 2.9 GHz, as shown by dashed line 124. In the presence of tuning stub 116, the resonance at 2.9 GHz may be tuned to a desired lower frequency of 2.4 GHz, as shown by curve 126.

Figure 7:
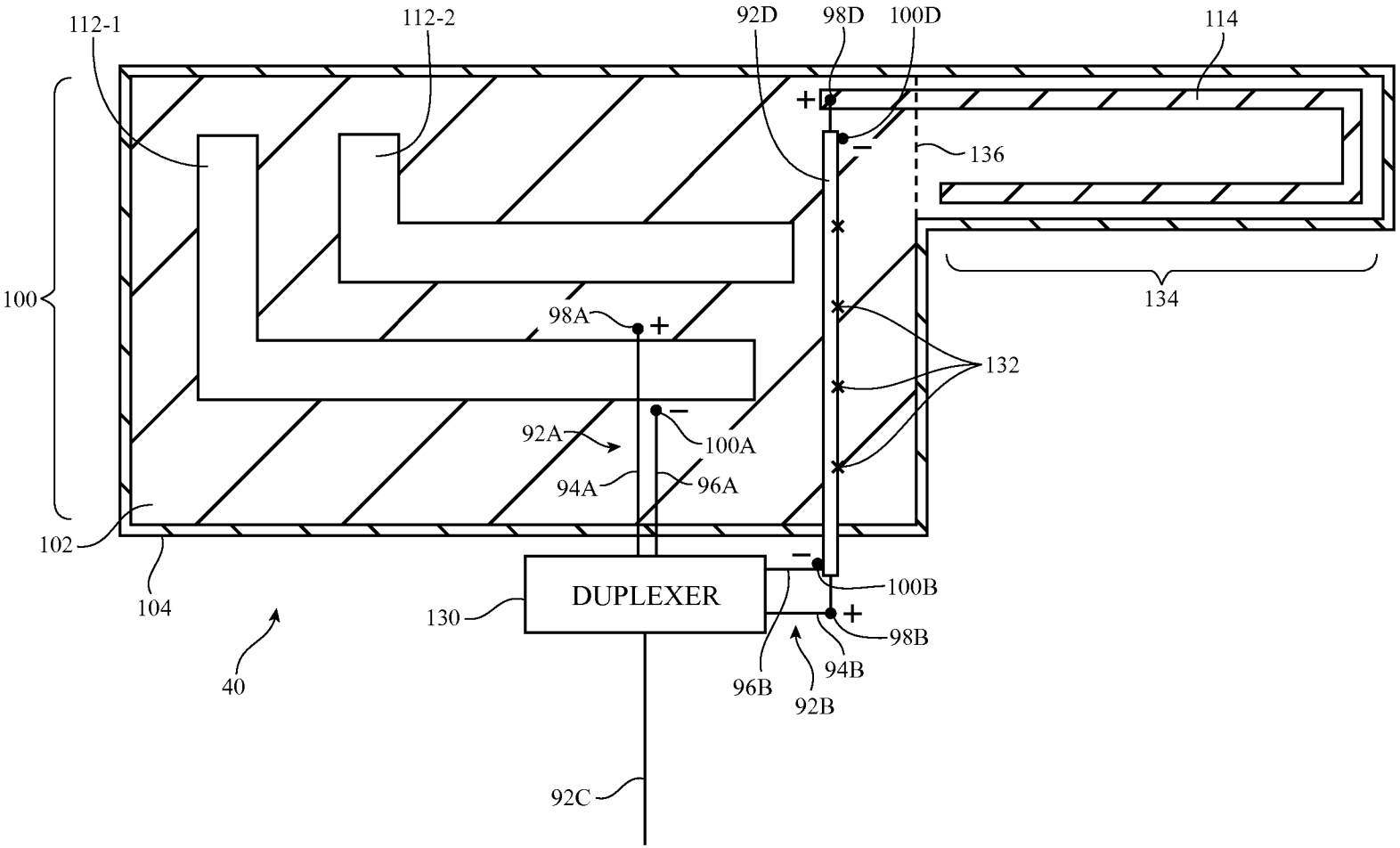
FIG. 7 is a top view of an illustrative cavity antenna with a directly fed slot, a parasitic slot, and monopole antenna in accordance with an embodiment.

In the illustrative example of FIG. 7, antenna 40 has cavity 100. Antenna 40 of FIG. 7 may operate at both 2.4 GHz and 5 GHz. Metal layer 102 covers the upper opening of cavity 100. Openings in layer 102 form slot antenna resonating element 112-1 and parasitic slot antenna resonating element 112-2, which are backed by cavity 100. Transmission line 92C is coupled between transceiver circuitry 90 and duplexer 130. Duplexer 130 has three ports. The first port of duplexer 130 is coupled to transmission line 92C and carries both 2.4 GHz and 5 GHz antenna signals. The second port of duplexer 130 is coupled to transmission line 92A and carries only 5 GHz antenna signals. The third port of duplexer 130 is coupled to transmission line 92B and carries only 2.4 GHz signals.

Transmission line 92A carries 5 GHz antenna signals for slots 112-1 and 112-2. Line 94A of transmission line 92A is coupled to positive antenna feed terminal 98A. Line 96A of transmission line 92A is coupled to ground antenna feed terminal 100A. Feed terminals 98A and 100A bridge slot 112-1 and directly feed slot 112-1. Through near-field electromagnetic coupling, slot 112-1 indirectly feeds parasitic slot antenna resonating element 112-2. Slots 112-1 and 112-2 have sizes selected to resonate at different portions of the 5 GHz band (e.g., 5.3 GHz and 5.7 GHz, or vice versa), thereby covering the 5 GHz band with a desired bandwidth. The use of a pair of slots in antenna 40, one of which is directly fed and the other of which serves as a bandwidth-broadening parasitic element is merely illustrative. If desired, different slot antenna configurations may be used for cavity antenna 40 of FIG. 7.

Transmission line 92B carries 2.4 GHz signals. Line 94B is coupled to positive terminal 98B of transmission line 92D. Line 96B is coupled to terminal 100B of transmission line 92D. Transmission line 92B may be a coaxial cable having a grounded outer conductor. The outer conductor of transmission line 92B may be electrically connected to metal layer 102 at electrical connections 132 (welds, solder joints, clamped metal tabs, conductive adhesive, etc.) along the length of transmission line 92B. Terminal 100D of coaxial cable 92D is coupled to metal layer 102. Terminal 98D is coupled to monopole antenna resonating element 114. Cavity 100 may have a protruding portion such as portion 134 that extends under monopole antenna element 114 or cavity 110 may have a wall that terminates along line 136 (as examples). Terminals 98D and 100D may serve as an antenna feed for monopole antenna resonating element 114. During operation, monopole element 114 may handle signals at 2.4 GHz and slots 112-1 and 112-2 may handle 5 GHz signals.

Figure 8:
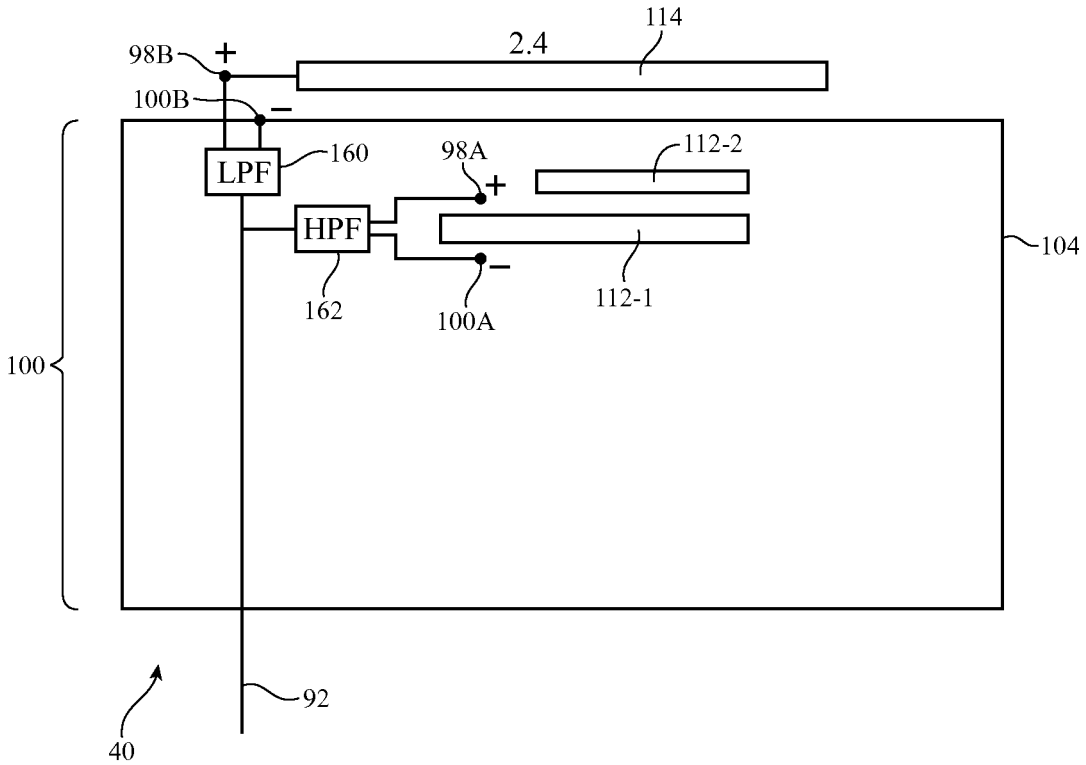
FIG. 8 is a top view of an illustrative cavity antenna having a directly fed slot, a parasitic slot antenna resonating element, and a monopole element that lies outside of the cavity in accordance with an embodiment.

In the illustrative configuration of FIG. 8, monopole antenna element 114 is formed outside of cavity 100. Transmission line 92 is coupled to transceiver circuitry 90 and carries 2.4 and 5 GHz signals. High pass filter 162 is interposed between transmission line 92 and slot antenna 112-1 and allows 5 GHz signals to pass to and from slot antenna 112-1 and parasitic slot antenna 112-2, which are backed by metal antenna cavity 100 Slot antenna 112-1 may be directly fed using feed terminals 98A and 100A, which bridge slot antenna 112-1. Parasitic slot antenna resonating element 112-2 is near-field coupled to slot 112-1 and may contribute a broadening resonance to the performance of antenna 40. For example, slot 112-1 may contribute a response at 5.2 GHz and parasitic slot 112-2 may contribute a response at 5.7 GHz.

Low pass filter 160 may allow 2.4 GHz signals to pass to and from monopole antenna resonating element 114. Monopole antenna resonating element 114 may have a length that is configured to resonate at 2.4 GHz. Terminals 98B and 100B may form an antenna feed for monopole 114.

The foregoing is merely illustrative and various modifications can be made by those skilled in the art without departing from the scope and spirit of the described embodiments. The foregoing embodiments may be implemented individually or in any combination.

What is claimed is:

1. A cavity antenna, comprising:
a slot antenna resonating element;
a monopole antenna resonating element;
a metal antenna cavity that backs the slot antenna resonating element and the monopole antenna resonating element; and
a transmission line tuning stub coupled to the monopole antenna resonating element through a filter.

2. The cavity antenna defined in claim 1, wherein the filter is a low pass filter coupled between the monopole antenna resonating element and the transmission line tuning stub.

3. The cavity antenna defined in claim 2 wherein the monopole antenna resonating element is directly fed.

4. The cavity antenna defined in claim 3 wherein the slot antenna resonating element comprises an indirectly fed parasitic slot antenna resonating element.

5. The cavity antenna defined in claim 4 wherein the indirectly fed parasitic slot antenna resonating element and the monopole antenna resonating element contribute antenna responses to a 5 GHz antenna band.

6. The cavity antenna defined in claim 5 wherein the metal antenna cavity is associated with a cavity resonance at a given frequency and wherein the transmission line tuning stub lowers the cavity resonance of the metal antenna cavity from the given frequency to 2.4 GHz.

7. The cavity antenna defined in claim 6 wherein metal antenna cavity comprises metal traces on a plastic carrier.

8. A cavity antenna, comprising:
a first slot antenna resonating element;
a second slot antenna resonating element;
a monopole antenna resonating element; and
a metal antenna cavity that is overlapped at least by the first and second slot antenna resonating elements, wherein the metal antenna cavity has a protruding portion that extends under the monopole antenna resonating element.

9. The cavity antenna defined in claim 8 wherein the first slot antenna resonating element is a directly fed slot antenna resonating element and wherein the second slot antenna resonating element is an indirectly fed parasitic slot antenna resonating element.

10. The cavity antenna defined in claim 9 wherein the monopole antenna resonating element resonates at 2.4 GHz.

11. The cavity antenna defined in claim 10 wherein the first and second slot antenna resonating elements contribute respective first and second antenna responses to an antenna resonance at 5 GHz.

12. The cavity antenna defined in claim 11 further comprising a duplexer having a first port coupled to a transceiver, a second port coupled to the directly fed slot antenna resonating element, and a third port coupled to the monopole antenna resonating element.

13. The cavity antenna defined in claim 12 further comprising a coaxial cable segment that extends from the third port to the monopole antenna resonating element, wherein the coaxial cable segment has an outer conductor.

14. The cavity antenna defined in claim 13 further comprising a metal layer covering a surface of the cavity, wherein the first and second slot antenna resonating elements are formed from respective first and second openings in the metal layer and the outer conductor of the coaxial cable segment is electrically connected to the metal layer along the coaxial cable.

15. The cavity antenna defined in claim 8 wherein the metal antenna cavity comprises a first portion having a periphery, the protruding portion extends beyond the periphery of the first portion, the first portion is overlapped by the first and second slot antenna resonating elements without being overlapped by the monopole antenna resonating element, and the protruding portion is overlapped by the monopole antenna resonating element without being overlapped by the first and second slot antenna resonating elements.

16. A cavity antenna, comprising:
an antenna cavity;
a first slot antenna resonating element that is backed by the antenna cavity;
a second slot antenna resonating element that is backed by the antenna cavity; and
a monopole antenna resonating element that is not backed by the antenna cavity.

17. The cavity antenna defined in claim 16 further comprising:
a low pass filter coupled to the monopole antenna resonating element.

18. The cavity antenna defined in claim 17 further comprising:
a high pass filter coupled to the first slot antenna resonating element.

19. The cavity antenna defined in claim 18 wherein the low pass filter passes 2.4 GHz signals to and from the monopole antenna resonating element and wherein the high pass filter passes 5 GHz signals to and from the first and second slot antenna resonating elements.

20. The cavity antenna defined in claim 19 wherein the first slot antenna resonating element is a directly fed antenna resonating element and wherein the second slot antenna resonating element is an indirectly fed parasitic slot antenna resonating element and wherein the first and second slot antenna resonating elements contribute respective first and second antenna responses to an antenna resonance at 5 GHz.

* * * * *